US007784322B2

(12) United States Patent
Heinicke

(10) Patent No.: US 7,784,322 B2
(45) Date of Patent: Aug. 31, 2010

(54) METHOD OF MAKING AN OPEN CAN END WITH HIGH PRESSURE VENTING

(75) Inventor: Paul R. Heinicke, Canton, OH (US)

(73) Assignee: Crown Packaging Technology, Inc., Alsip, IL (US)

( * ) Notice: Subject to any disclaimer, the term of this patent is extended or adjusted under 35 U.S.C. 154(b) by 365 days.

(21) Appl. No.: 11/678,165

(22) Filed: Feb. 23, 2007

(65) Prior Publication Data

US 2008/0067175 A1 Mar. 20, 2008

Related U.S. Application Data

(63) Continuation-in-part of application No. 11/533,136, filed on Sep. 19, 2006, now Pat. No. 7,673,490.

(51) Int. Cl.
*B21D 11/10* (2006.01)
*B21D 51/44* (2006.01)

(52) U.S. Cl. ..... 72/379.4; 413/8; 413/12; 413/15; 413/17

(58) Field of Classification Search ..... 72/347, 72/348, 379.4; 413/8, 12–17, 56, 66, 67, 413/68; 220/269, 270, 272, 273; 493/56, 493/59, 160
See application file for complete search history.

(56) References Cited

U.S. PATENT DOCUMENTS 3,501,046 A * 3/1970 Jasper et al. ..... 220/273
3,735,892 A 5/1973 Kinkel
3,762,596 A * 10/1973 Henning et al. ..... 220/273
3,951,299 A 4/1976 Khoury
4,056,210 A * 11/1977 Boyle ..... 220/712
4,182,460 A 1/1980 Holk, Jr. et al.
5,052,573 A 10/1991 Zysset
5,232,114 A 8/1993 Zysset
5,252,019 A 10/1993 Saunders et al.
5,816,429 A 10/1998 Kobayashi

* cited by examiner

*Primary Examiner*—Dana Ross
*Assistant Examiner*—Teresa M Bonk
(74) *Attorney, Agent, or Firm*—Knoble Yoshida & Dunleavy, LLC

(57) ABSTRACT

An improved convenience closure that is adapted for sealing an end of a can includes an end panel having a peripheral score, a rivet formation, a mustache score and a flex line score defined therein. The mustache score may include a central portion that is positioned radially inwardly on the end panel relative to the rivet formation. The central portion is preferably curved, with a concave side of the curvature facing the rivet formation. The mustache score also may include first and second preferably symmetrical end portions, each of which is continuous with the central portion. Most of the total length of each of the end portions may be curved away from a nearest portion of the peripheral score, with a convex side of curvature facing the nearest portion of the peripheral score. Tooling for making the convenience closure and a method of making such a convenience disclosure are also disclosed.

19 Claims, 9 Drawing Sheets

FIG. 8
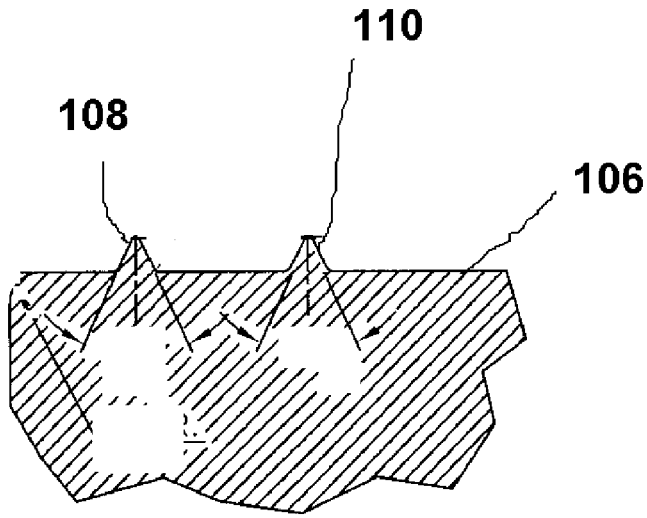
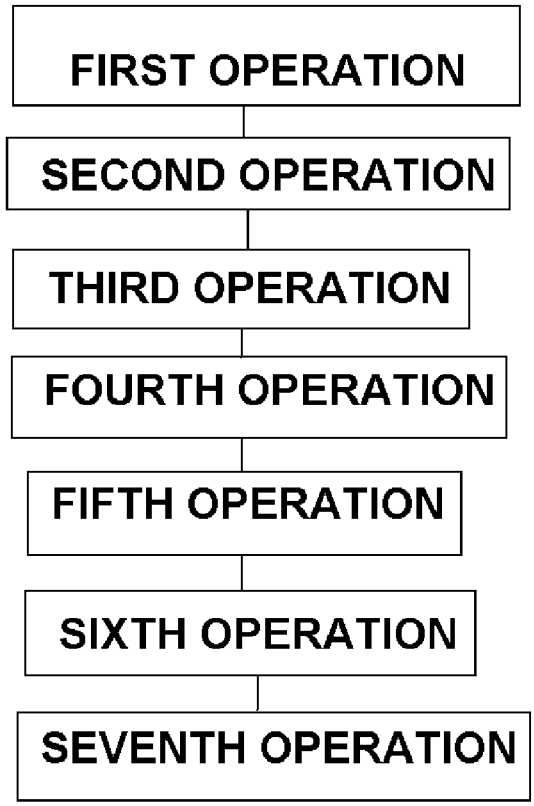
FIG. 9

METHOD OF MAKING AN OPEN CAN END WITH HIGH PRESSURE VENTING

This is a continuation-in-part of Ser. No. 11/533,136, filed Sep. 19, 2006, the entire disclosure of which is hereby incorporated by reference as if set forth fully herein.

BACKGROUND OF THE INVENTION

1. Field of the Invention

This invention relates broadly to the field of convenience closures for full-open type can ends. More specifically, this invention relates to an improved rivet formation for attaching a gripping tab to an end panel of such a can end.

2. Description of the Related Technology

One form of self-opening can which is in wide use is the so called full-open can, in which a peripheral score, generally circular in configuration, is formed in the end panel at or adjacent to the periphery thereof to permit its complete removal.

Full-open type cans are to be distinguished from those self opening cans which have a comparatively small removable section which, when opened, provide a comparatively small hole for dispensing the product. The latter type of can end is only appropriate for packaging soda, beer, or other liquids. Full-open type cans, on the other hand, are suitable for packaging solid products such as candy, nuts, meats, or ground coffee.

A conventional full-open type can end of the type disclosed in U.S. Pat. No. 5,232,114 to Zysset is depicted in FIG. 1. Can end 10 conventionally includes an end panel 12 and an edge-curled peripheral flange 14 that is adapted to be interfolded with an end flange of a can body. At or adjacent to the periphery of end panel 12 is a peripheral score 16 which is indented into the end panel 12 and defines a fixed can end portion 18 and a removable portion or panel 20. A gripping tab 22 is mounted to the end panel 12 by means of a rivet formation 24.

The gripping tab 22 is positioned close enough to the peripheral score 16 so that when its inner end is rocked upwardly to cause its outer end to move downwardly and exert a downward force on the end panel 12 at or near the peripheral score 16, a portion of the end panel 12 is bent downwardly to initiate rupture of the peripheral score 16. Thereafter, an upward and backward pull on the gripping tab 22 by the user induces tearing of the metal in the peripheral score 16 on both sides of the area of initial rupture to complete detachment from the can of the removable portion or panel 20 of the end panel 12.

It is also known within the prior art to employ a vent score behind the rivet formation 24 toward the center of the end panel 12 in order to relieve internal pressure or vacuum that exists within the container, and thereby avoid implosion or explosion as the container 12 is opened by rotation of the gripping tab 22 about the rivet formation 24. The most frequently used shape for the vent score is curved like a man's mustache and therefore these scores are generally known as "mustache scores."

For the aforesaid purposes and to promote flexibility and to provide a hinge point for the tab 22 when it is lifted, a mustache score 34 may be formed in the end panel 12, as is illustrated in FIG. 1. Mustache score 34 typically has an inner portion 36 that is defined on a raised area 26 of rivet formation 24 having an outer edge 27, and at least one outer portion 38 that is defined on the outer surface of end panel 12. Raised area 26 includes an oval shaped first operation bubble 40, which is elongated along an axis which is a chord perpendicular to a radius of end panel 12. Raised area 26 further includes a second operation bubble 30, which is defined centrally with respect to the first operation bubble 40.

The inner portion 36 of mustache score 34 may be curved about the radial inner periphery of the second operation bubble 30. The outer portions 38 of the mustache score 34 would typically be shaped so as to flare outwardly from the respective inner portions 36, and would typically end up at their extreme outer ends to be substantially parallel or slightly curved away from the peripheral score 16.

Although conventional mustache scores such as the one that is described above are generally effective in preventing violent explosions or implosions during the opening of containers that are moderately pressurized or underpressurized, they tend to be ineffective in preventing explosions during the opening of highly pressurized containers. A highly pressurized container for purposes of this document is a container that is pressurized at least 25 pounds per square inch over ambient pressure conditions.

A need exists for an improved easy open can end that can be used with highly pressurized containers and that is capable of effectively reducing the likelihood of a violent explosion or implosion occurring when such a highly pressurized container is opened.

SUMMARY OF THE INVENTION

Accordingly, it is an object of the invention to provide an improved easy open can end that can be used with highly pressurized containers and that is capable of effectively reducing the likelihood of a violent explosion or implosion occurring when such a highly pressurized container is opened.

In order to achieve the above and other objects of the invention, a method of making a convenience closure according to a first aspect of the invention includes providing an end panel; forming a mustache score in the end panel; and forming a flex line score in the end panel adjacent to said mustache score, the flex line score having a first linear portion and a second curved portion.

A method of making a convenience closure according to a second aspect of the invention includes providing an end panel; forming a rivet formation in said end panel; forming a mustache score in the end panel; and forming a flex line score in the end panel adjacent to said rivet formation, the flex line score having a first linear portion and a second curved portion.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

FIG. 8 is a fragmentary cross-sectional view depicting a forming tool according to the preferred embodiment of the invention;

FIGS. 9(*a*) through 9(*g*) are a series of diagrammatical depictions of a cross-section of the end panel showing seven forming operations in a preferred method of forming an easy open can end according to a preferred embodiment of the invention.

DETAILED DESCRIPTION OF THE PREFERRED EMBODIMENT(S)

Figure 1:
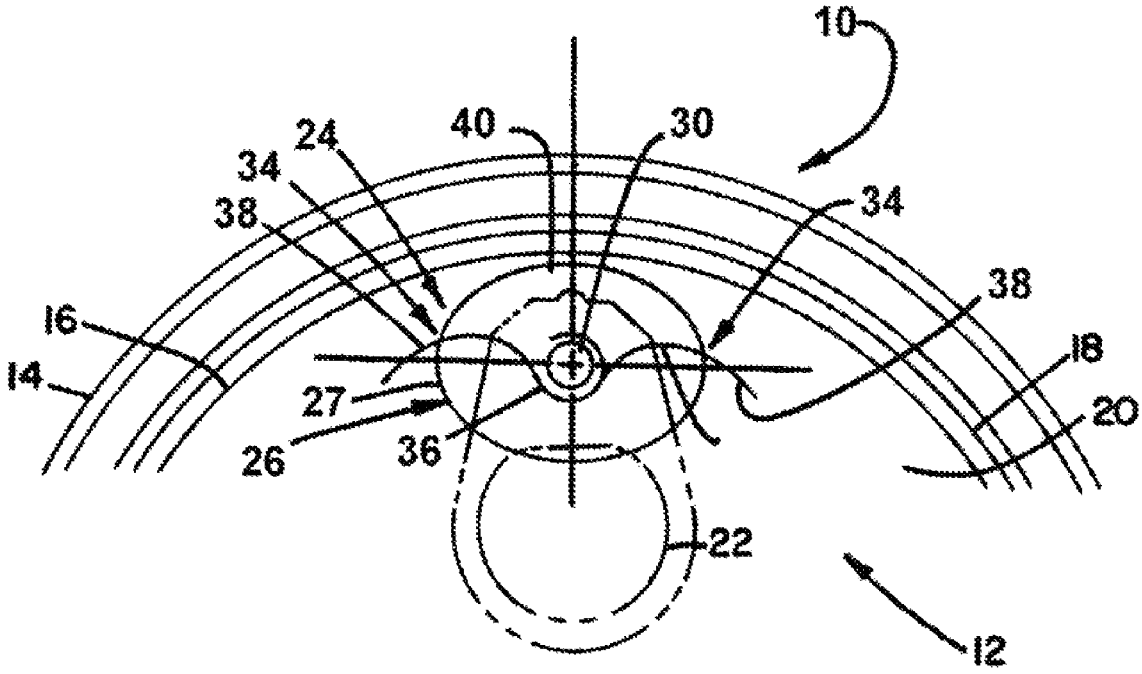
FIG. 1 (PRIOR ART)
FIG. 1 is a diagrammatical view of a previously known easy open can end configuration.
Figure 2:
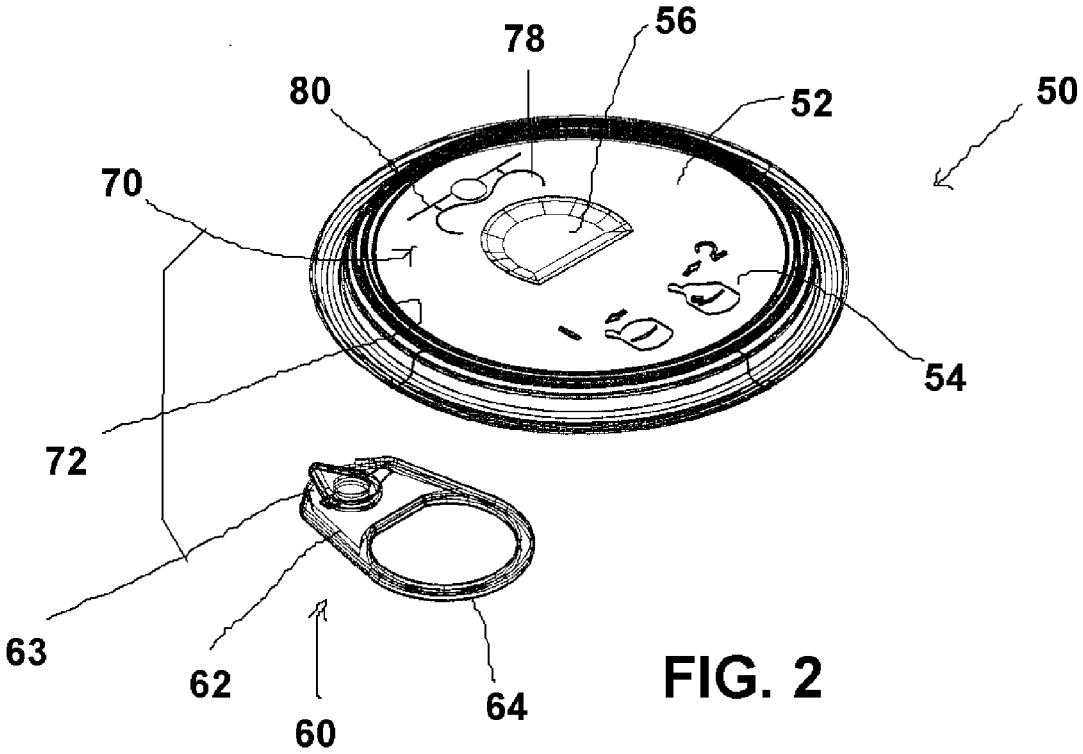
FIG. 2 is a perspective view of an easy open can end that is constructed according to a preferred embodiment of the invention.
Figure 3:
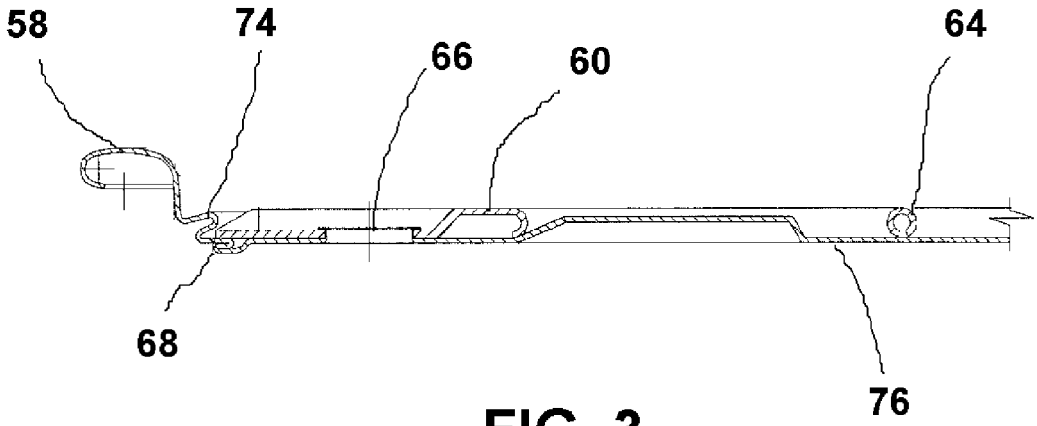
FIG. 3 is a fragmentary cross-sectional view of the easy open can end that is depicted in FIG. 2.

Referring now to the drawings, wherein like reference numerals designate corresponding structure throughout the views, and referring in particular to FIGS. 2 and 3, a full open convenience closure or easy open can end 50 that is constructed according to a preferred embodiment of the invention includes an end panel 52 that has pictorial opening instructions 54 embossed thereon. As is conventional, a peripheral score 72 has been formed in the end panel 52 and defines a fixed portion 74 of the end panel 52 and a removable portion 76 of the end panel 52. A finger well 56 is defined in an upper surface of the end panel 52.

Full open convenience closure 50 further includes a circumferentially extending end curl 58 that is constructed and arranged to be secured to a container using the double seaming process. It also includes a tab 60 that has a main body portion 62 including a nose portion 63 that is constructed and arranged to exert a downward force on the end panel 52 in area that is proximate to the peripheral score 72 when a lifting ring 64 of the tab 60 is lifted by a consumer. A rivet formation 66 secures the tab 60 to the end panel 52. Convenience closure 50 further preferably includes a double fold 68 that is defined in the end panel 52 adjacent to the peripheral score 72 in order to provide cut protection for the consumer.

Figure 7:
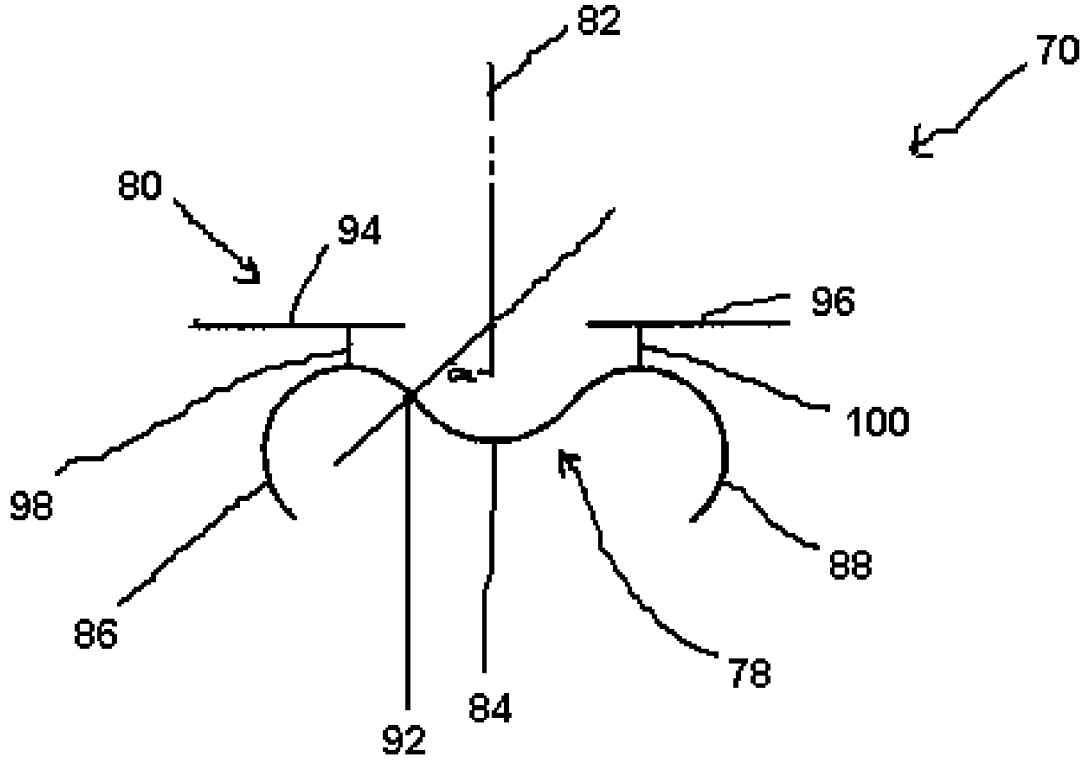
FIG. 7 is a diagrammatical depiction of the opening score pattern that is shown in FIG. 5.

According to one particularly advantageous feature of the invention, a plurality of opening scores 70 are preferably defined in the end panel 52 in an area that is generally proximate to the location of the rivet formation 66. The opening scores 70 preferably include a mustache score 78, a flex line score 80 and a pair of break line scores 98, 100, which are best shown in FIG. 7. Although in the preferred embodiment the end panel 52 has all of these scores defined therein it should be understood that in alternative embodiments of the invention the mustache score 78 could be provided without a flex line score, with or without a break line score.

FIG. 7 provides a more detailed view of the opening scores 70 in the preferred embodiment. As FIG. 7 shows, the mustache score 78 preferably includes a central portion 84 that is positioned radially inwardly on the end panel 52 relative to the rivet formation 66 and is curved about the rivet formation 66 in such a manner that a concave side of the central portion 84 faces the rivet formation 66. The curvature of the central portion 84 is preferably a constant radius of curvature.

Mustache score 78 further preferably includes first and second end portions 86, 88 that are preferably symmetric with respect to each other about a diametric axis of symmetry 82 that extends through the center 90 of the rivet formation 66. Each of the first and second end portions 86, 88 preferably includes a convex side of curvature that faces the nearest portions of the peripheral score 72.

Each of the first and second end portions 86, 88 preferably have a constant radius of curvature R1 that preferably extends along an arc section that is at least about 150°. The constant radius of curvature R1 is preferably substantially within a range of about 0.07 inches to about 0.2 inches.

The distal ends of the first and second end portions 86, 88 in the preferred embodiment point away from the nearest portion of the peripheral score 72, and a tangent line extending through the distal ends would preferably be substantially perpendicular to a tangent line of the peripheral score 72 at a location where the first tangent line would intersect the peripheral score 72.

Preferably, a transition location 92 between the central portion 84 and the first and portion 86 is located at a transitional angle $\alpha$ from the diametric axis of symmetry 82 that is preferably substantially within a range of about 45° to about 60°. More preferably, this angle is substantially within a range of about 50° to about 55°.

The flex line score 80 preferably has a first portion 94 that is located on a first side of the rivet formation 66 and a second portion 96 that is located on a second, opposite side of the rivet formation 66. The first and second portions 94, 96 of the flex line score 80 are preferably aligned and symmetric with respect to each other. The flex line score 80 and its components 94, 96 are preferably substantially perpendicular with respect to the diametric axis of symmetry 82.

The flex line score 80 preferably has a residual thickness (i.e., a thickness that remains in the end panel 52 at the location of the score line 80) that is substantially the same as a residual thickness of the mustache score 78. The flex line score 80 further preferably has a residual thickness that is within a range of about 25% to about 40% of a thickness of the end panel 52. More preferably, the flex line score 80 has a residual thickness that is substantially within a range of about 30% to about 35% of the thickness of the end panel 52.

The mustache score 78 has a residual thickness that is preferably substantially within a range of about 25% to about 40% of the thickness of the end panel 52. More preferably, the mustache score 78 has a residual thickness that is substantially within a range of about 30% to about 35% of the thickness of the end panel 52. The mustache score 78 preferably has a residual thickness that is no greater than about 0.0045 inches, and more preferably no greater than about 0.0035 inches.

As FIG. 7 shows, the portions of the mustache score 78 that most closely approach the flex line score 80 present a convex side of curvature that faces the flex line score 80.

In the preferred embodiment of the invention, a pair of break line scores 98, 100 are defined in the end panel 52 in order to provide a pre-weakened tearing path between the mustache score 78 and the flex line score 80 that is utilized by the convenience closure 50 during the preliminary stages of opening. The break line scores 98, 100 are positioned between the mustache score 78 and the flex line score 80.

Each of the break line scores 98, 100 are preferably substantially perpendicular to the flex line score 80 and are aligned with the locations on the respective first and second end portions 86, 88 of the mustache score 78 that most closely approach the flex line score 80.

The break line scores 98, 100 are preferably substantially perpendicular with respect to tangent lines that would pass through the locations on the respective first and second end portions 86, 88 of the mustache score 78 that most closely approach the flex line score 80. The break line scores 98, 100 preferably have a residual thickness that is greater than a residual thickness of the flex score line 80 and that is greater than a residual thickness of the mustache score 78. The residual thickness of the break line scores 98, 100 is preferably substantially within a range of about 30% to about 95% of the thickness of the end panel 52, with a more preferred range of about 50% to about 80% of the thickness of the end panel 52.

When the convenience closure 50 is used in conjunction with a can body to package contents under high pressure (i.e. over 20 psi), it may be opened by a consumer by gripping the lifting tab and pulling the lift ring 64 upwardly.

As the gripping tab 60 pivots about the rivet formation 66, the nose portion 63 will move downwardly and exert a downward force on the end panel 52 at or near the peripheral score 72. Before the end panel 52 is bent downwardly enough to initiate rupture of the peripheral score 74, however, sufficient tension is formed in the end panel 52 in the area near the central portion 84 of the mustache score 78 to cause a rupture of the end panel at the central portion 84.

Pressurized gas within the container will be permitted to harmlessly vent through the rupture in the central portion 84 of the mustache score 78 without affecting the integrity of the peripheral score 72 or accelerating the opening process. The flow of pressurized gas will tend to be directed harmlessly at an oblique angle beneath the fingers of the consumer across the top of the end panel 52 so as not to present a hazard to the consumer.

The presence of the flex score line 80 reduces the amount of force that will need to be exerted by the consumer to cause the initial rupture of the central portion 84 of the mustache score 78.

After the convenience closure 50 has vented, the consumer will continue to pull the lifting ring 64 upwardly, which causes the tear or rupture in the central portion 84 of the mustache score 78 to enlarge. The tearing will progressively advance into the first and second end portions 86, 88 of the mustache score. At the location on the first and second end portions 86, 88 that are closest to the flex line score, the tear line will leave the mustache score and advance directly to the respective first and second portions 94, 96 of the flex line score 80 along the path of the break line scores 98, 100. This will occur even in embodiments of the invention where the break line scores 98, 100 are not present.

Figure 10:
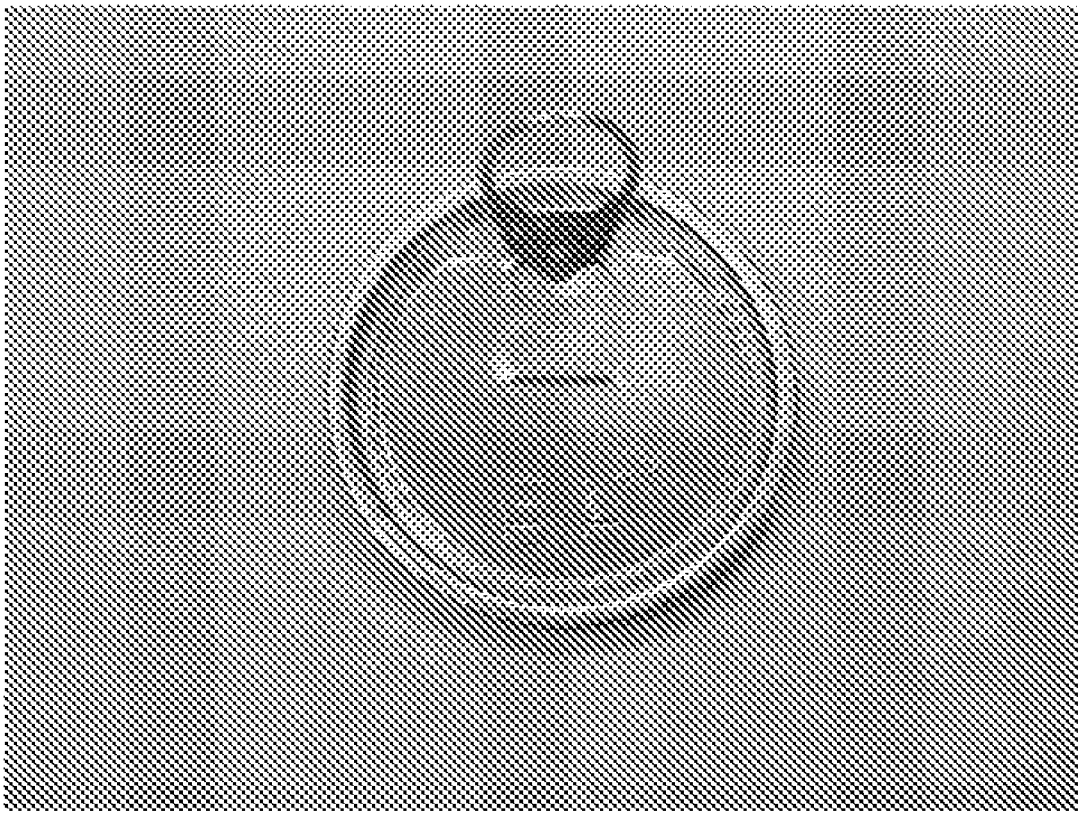
FIG. 10 is a photograph depicting an easy open can end according to the preferred embodiment of the invention after an initial opening step.

The tearing will then move laterally outwardly along the respective first and second portions 94, 96 of the flex line score 80. As this occurs, sufficient downward force will be exerted by the nose portion 63 of gripping tab to rupture the peripheral score 74. This stage of opening is shown in the photograph that is provided as FIG. 10. The consumer at this time may pull the lift ring 64 back to cause the peripheral score 74 to tear, thus removing the removable portion 76 of the end panel 52 from the fixed portion 74.

Figure 4:
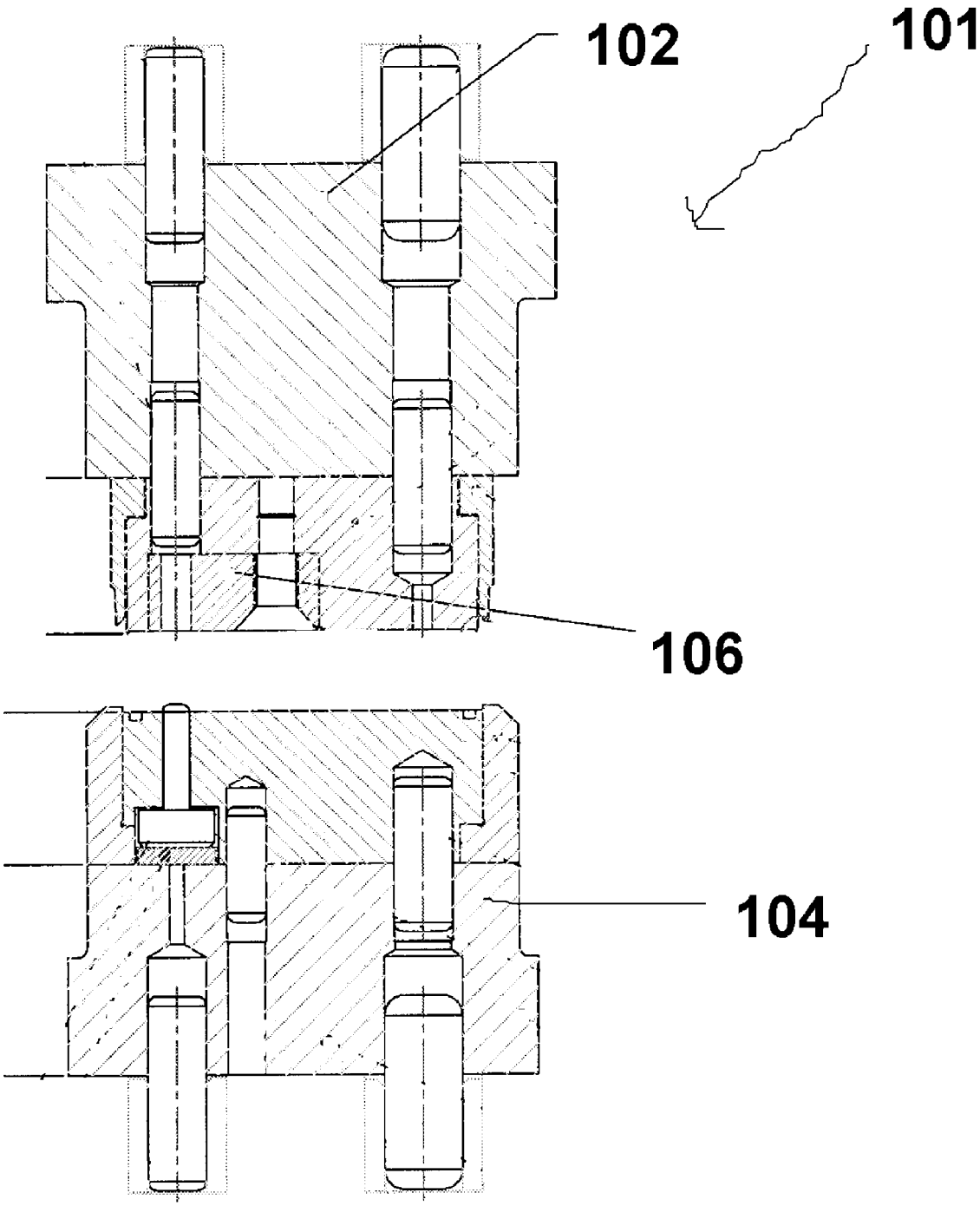
FIG. 4 is a fragmentary cross-sectional view of a press assembly that is preferably used in accordance with a preferred embodiment of the invention.

Referring now to FIG. 4, the tooling assembly for forming the convenience closure 50 according to the preferred embodiment includes a third operation press assembly 101 including an upper portion 102 and a lower portion 104 that are mounted for movement with respect to each other. The tooling assembly further preferably includes a first forming tool 106 for forming a top surface of the end panel 52 of the convenience closure 50.

Figure 5:
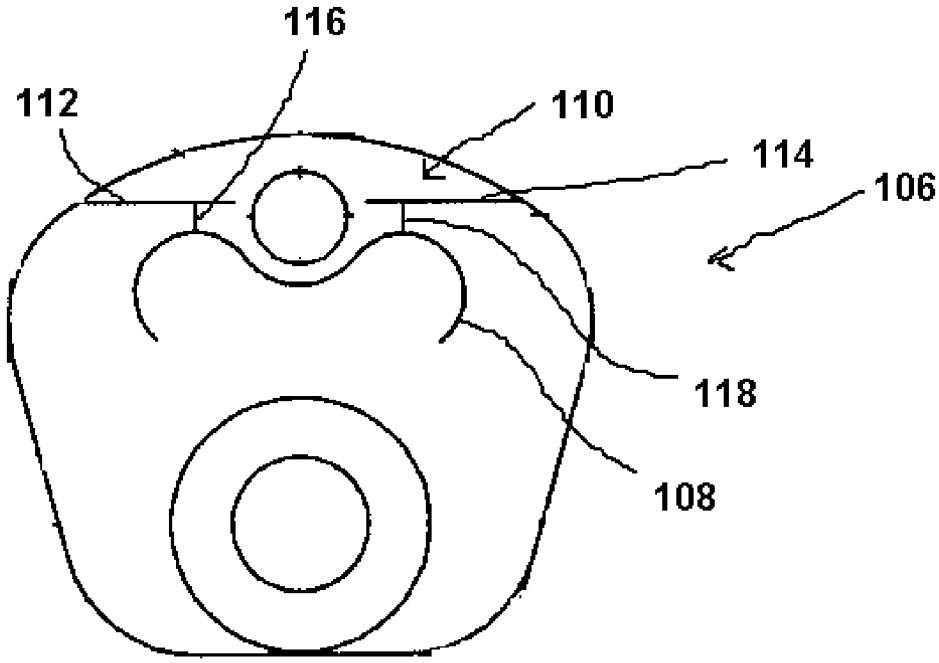
FIG. 5 is a diagrammatical depiction of an opening score pattern and a forming tool according to a preferred embodiment of the invention.

Looking now to FIG. 5, it will be seen that the first forming tool 106 preferably includes a first tool surface 108 that is constructed and arranged to form the mustache score 78 and a second tool surface 110 that is constructed and arranged to form the flex line score 80. The second tool surface 110 includes a first portion 112 for forming the first portion 94 of the flex line score 80 and a second portion 114 for forming the second portion 96 of the flex line score 80.

First forming tool 106 also preferably includes a third tool surface 116 for forming the first break line score 98 and a fourth tool surface 118 for forming the second break line score 100. As is shown in FIG. 8, both the first tool surface 108 and the second tool surface 110 are formed as projections that extend outwardly from the substantially flat, horizontal base surface of the first forming tool 106.

Figure 6:
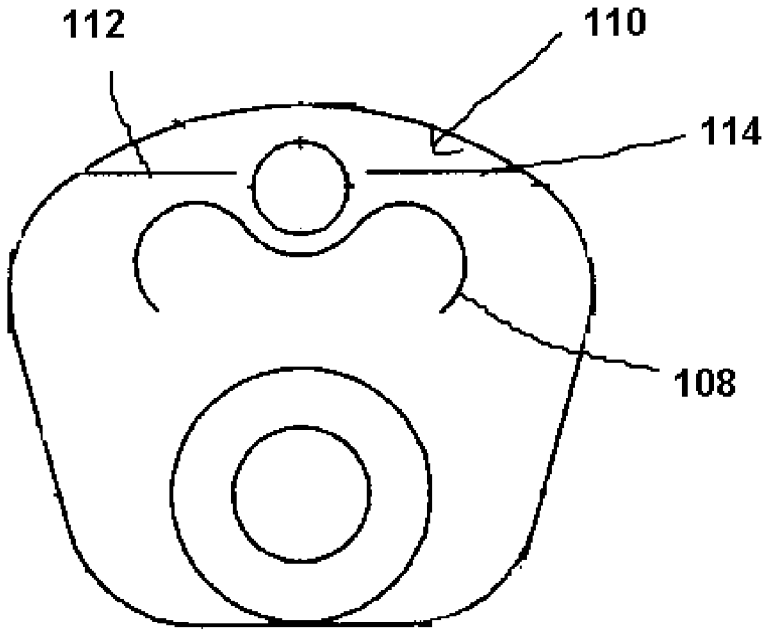
FIG. 6 is a diagrammatical depiction of an opening score pattern and a forming tool according to a modified embodiment of the invention.

FIG. 6 depicts a first forming tool 120 according to a modified embodiment of the invention. First forming tool 120 is identical in all respects to the first forming tool 106 described above, except that it lacks the third and fourth tool surfaces 116, 118 for forming the first and second break line scores 98, 100. First forming tool 120 would be used to manufacture a convenience closure according to a modified embodiment of the invention in which the break line scores 98, 100 are not present.

A method of making such a convenience closure 50 according to the preferred embodiment of the invention would include a step of providing an end panel blank and providing the tooling discussed above in relation to FIGS. 4-6. The tooling would be used in otherwise conventional fashion to form the convenience closure that is discussed in detail above.

The preferred method of making the convenience closure 50 utilizes a seven operation manufacturing process. A cross-sectional view of the end panel after each operation is shown diagrammatically in FIGS. 9(*a*) through 9(*g*).

The first forming operation shown in FIG. 9(*a*), is used to form the rivet bubble formation on the end panel blank.

The second forming operation, shown in FIG. 9(*b*), completes the formation of the rivet button and begins the formation of a lower safety fold.

The third forming operation, shown in FIG. 9(*c*), forms the score lines that have been described in detail above and pre-folds an upper safety fold.

The fourth operation, shown in FIG. 9(*d*), completes the folding of the lower safety fold.

The fifth operation, shown in FIG. 9(*e*), involves the staking of the tab to the end panel and a final rivet operation.

The sixth operation, shown in FIG. 9(*f*), includes a tab detect function as well as a step of forming an upper fold pre-bulge.

The seventh and final operation, shown in FIG. 9(*g*), involves a step of completing the folding of the upper fold into a position where it will afford cut protection.

Figure 11:
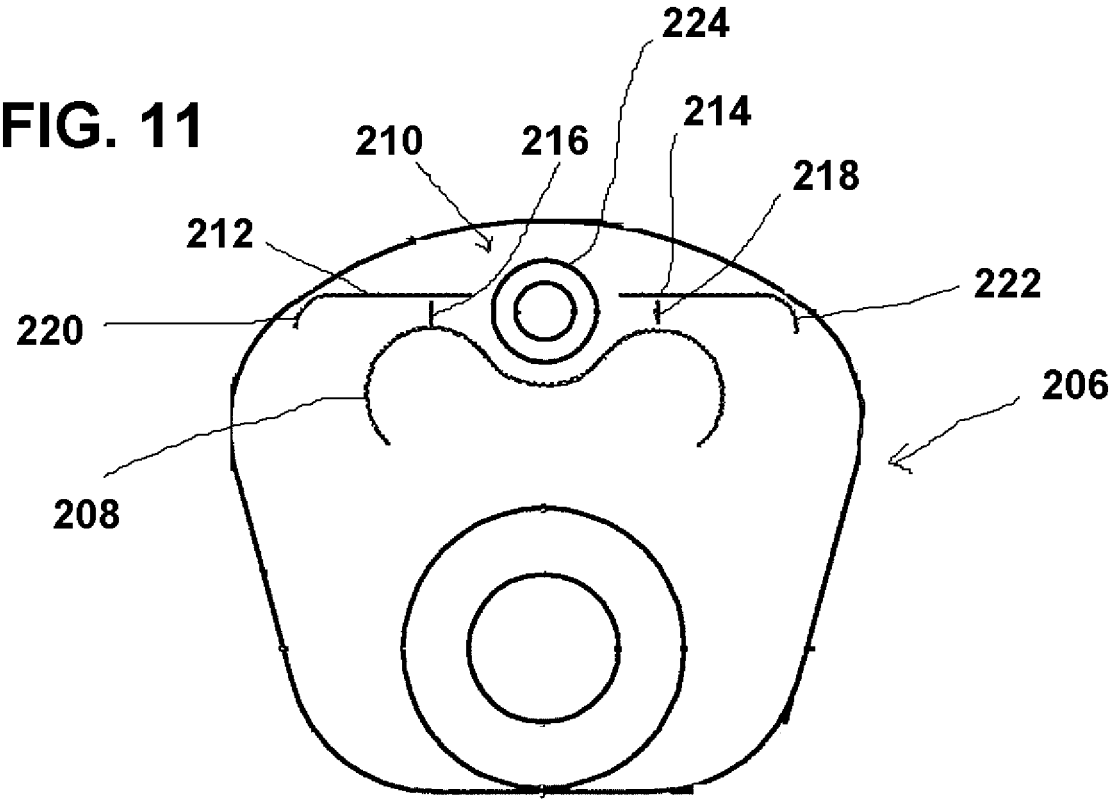
FIG. 11 is a diagrammatical depiction of an improved opening score pattern and a forming tool according to the preferred embodiment of the invention.
Figure 12:
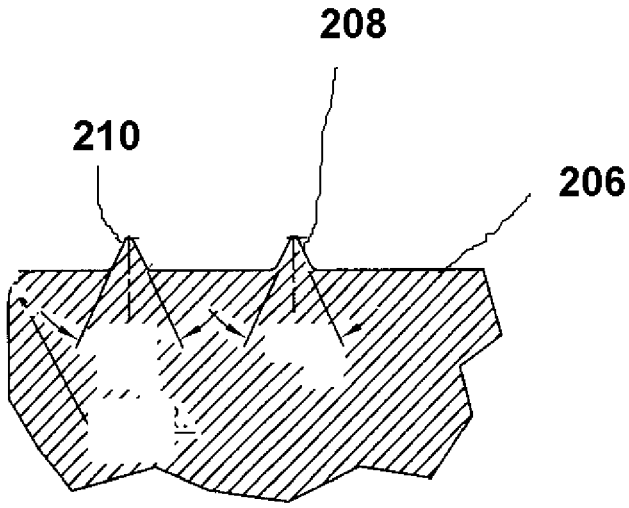
FIG. 12 is a fragmentary cross-sectional view depicting a forming tool according to the preferred embodiment of the invention.
Figure 13:
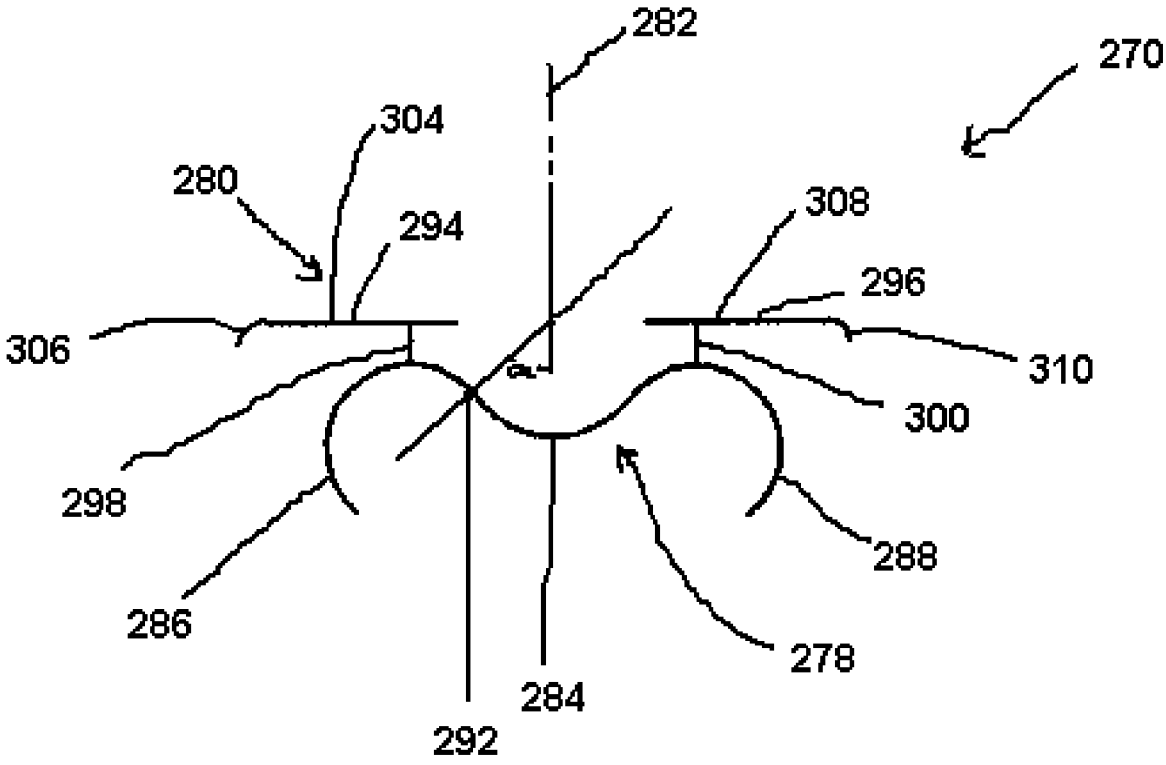
FIG. 13 is a diagrammatical depiction of the opening score pattern that is shown in FIG. 11.

Referring now to FIGS. 11-13, an easy open can end that is constructed according to a second, preferred embodiment of the invention is identical to that described above with regard to the first embodiment of the invention except as otherwise described herein.

As FIG. 13 shows, a plurality of opening scores 270 are preferably defined in the end panel of the can end in an area that is generally proximate to the location of the rivet formation 224, shown in FIG. 11. The opening scores 270 preferably include a mustache score 278, a flex line score 280 and a pair of break line scores 298, 300, which are best shown in FIG. 13. Although in the preferred embodiment the end panel has all of these scores defined therein it should be understood that in alternative embodiments of the invention the mustache score 278 could be provided without a flex line score, with or without a break line score.

As FIG. 13 shows, the mustache score 278 preferably includes a central portion 284 that is positioned radially inwardly on the end panel relative to the rivet formation 224 and is curved about the rivet formation 224 in such a manner that a concave side of the central portion 284 faces the rivet formation 224. The curvature of the central portion 284 is preferably a constant radius of curvature.

Mustache score 278 further preferably includes first and second end portions 286, 288 that are preferably symmetric with respect to each other about a diametric axis of symmetry 282 that extends through the center of the rivet formation 224. Each of the first and second end portions 286, 288 preferably includes a convex side of curvature that faces the nearest portions of the peripheral score 272. Each of the first and second end portions 286, 288 preferably have a constant radius of curvature R1 that preferably extends along an arc section that is at least about 150°. The constant radius of curvature R1 is preferably substantially within a range of about 0.07 inches to about 0.2 inches.

The distal ends of the first and second end portions 286, 288 in the preferred embodiment point away from the nearest portion of the peripheral score 272, and a tangent line extending through the distal ends would preferably be substantially perpendicular to a tangent line of the peripheral score 272 at a location where the first tangent line would intersect the peripheral score 272.

Preferably, a transition location 292 between the central portion 284 and the first end portion 286 is located at a transitional angle $\alpha$ from the diametric axis of symmetry 282 that is preferably substantially within a range of about 45° to about 60°. More preferably, this angle is substantially within a range of about 50° to about 55°.

The flex line score 280 preferably has a first portion 294 that is located on a first side of the rivet formation 224 and a second portion 296 that is located on a second, opposite side of the rivet formation 224. The first portion 294 in this embodiment of the invention preferably includes a substantially linear portion 304 that is proximate to the rivet formation 224 and a second, curved portion 306 at an end of the first portion 294 that is distal from the rivet formation 224.

Similarly, the second portion 294 in this embodiment of the invention preferably includes a substantially linear portion 308 that is proximate to the rivet formation 224 and a second, curved portion 310 at an end of the second portion 296 that is distal from the rivet formation 224.

One purpose of the curved portions 306, 310 is to deter possible tearing from occurring near the outer distal ends of the first and second flex line score portions 294, 296 during and after opening of the easy open end by a consumer.

The first and second portions 294, 296 of the flex line score 280 are preferably aligned and symmetric with respect to each other.

The linear portions 304, 308 of the flex line score 280 and its components 294, 296 are preferably substantially perpendicular with respect to the diametric axis of symmetry 282.

The flex line score 280 preferably has a residual thickness (i.e., a thickness that remains in the end panel at the location of the score line 280) that is substantially the same as a residual thickness of the mustache score 278. The flex line score 280 further preferably has a residual thickness that is within a range of about 25% to about 40% of a thickness of the end panel. More preferably, the flex line score 280 has a residual thickness that is substantially within a range of about 30% to about 35% of the thickness of the end panel.

The mustache score 278 has a residual thickness that is preferably substantially within a range of about 25% to about 40% of the thickness of the end panel. More preferably, the mustache score 278 has a residual thickness that is substantially within a range of about 30% to about 35% of the thickness of the end panel. The mustache score 278 preferably has a residual thickness that is no greater than about 0.0045 inches, and more preferably no greater than about 0.0035 inches.

As FIG. 13 shows, the portions of the mustache score 278 that most closely approach the flex line score 280 present a convex side of curvature that faces the flex line score 280.

In this preferred embodiment of the invention, a pair of break line scores 298,300 are defined in the end panel in order to provide a pre-weakened tearing path between the mustache score 278 and the flex line score 280 that is utilized by the convenience closure during the preliminary stages of opening. The break line scores 298, 300 are positioned between the mustache score 278 and the flex line score 280. Each of the break line scores 298, 300 are preferably substantially perpendicular to the flex line score 280 and are aligned with the locations on the respective first and second end portions 286, 288 of the mustache score 278 that most closely approach the flex line score 280.

The break line scores 298, 300 are preferably substantially perpendicular with respect to tangent lines that would pass through the locations on the respective first and second end portions 286, 288 of the mustache score 278 that most closely approach the flex line score 280.

The break line scores 298, 300 preferably have a residual thickness that is greater than a residual thickness of the flex score line 280 and that is greater than a residual thickness of the mustache score 278. The residual thickness of the break line scores 298, 300 is preferably substantially within a range of about 30% to about 95% of the thickness of the end panel, with a more preferred range of about 50% to about 80% of the thickness of the end panel.

The presence of the flex score line 280 reduces the amount of force that will need to be exerted by the consumer to cause the initial rupture of the central portion 284 of the mustache score 278.

Looking now to FIG. 11, it will be seen that the first forming tool 206 preferably includes a first tool surface 208 that is constructed and arranged to form the mustache score 278 and a second tool surface 210 that is constructed and arranged to form the flex line score 280. The second tool surface 210 includes a first portion 212 for forming the first linear portion 304 of the first portion 294 of the flex line score 280 and a second portion 220 for forming the curved portion 306 of the first portion 294 of the flex line score 280. It further includes a third portion 214 for forming the linear portion 308 of the second portion 296 of the flex line score 280 and a fourth portion 220 for forming the curved portion 310 of the second portion 296 of the flex line score 280.

First forming tool 206 also preferably includes a third tool surface 216 for forming the first break line score 298 and a fourth tool surface 218 for forming the second break line score 300. As is shown in FIG. 12, both the first tool surface 208 and the second tool surface 210 are formed as projections that extend outwardly from the substantially flat, horizontal base surface of the first forming tool 206.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A method of making a convenience closure, comprising:

providing an end panel;

forming a curved mustache score in said end panel;

forming a flex line score in said end panel adjacent to said mustache score, said flex line score having a first linear portion and a first curved portion;

forming a first break line score extending between and contacting both the first linear portion and the mustache score, further wherein the first break line score is perpendicular to the first linear portion; and wherein the mustache score is located more radially inwardly on the end panel than said first curved portion.

2. A method according to claim 1, further comprising forming a rivet formation in said end panel, and wherein said flex line score is adjacent to said rivet formation.

3. A method according to claim 2, wherein said flex line score is defined along a flex line score axis, and wherein said flex line score axis intersects said rivet formation.

4. A method according to claim 1, wherein said end panel has a diametric axis of symmetry, and wherein said first linear portion of said flex line score is substantially perpendicular to said diametric axis of symmetry.

5. A method according to claim 1, wherein said first linear portion is located on a first side of a rivet formation and a second linear portion is located on a second, opposite side of said rivet formation.

6. A method according to claim 1, wherein said first linear portion of said flex line score is located proximate to a rivet formation.

7. A method according to claim 6, wherein said first curved portion of said flex line score is located distal to said rivet formation.

8. A method according to claim 1, wherein said first curved portion of said flex line score is curved toward said mustache score.

9. A method of making a convenience closure, comprising:

providing an end panel;

forming a rivet formation in said end panel;

forming a mustache score in said end panel, wherein said mustache score has a central portion positioned radially inwardly on the end panel relative to the rivet formation; and forming a flex line score in said end panel adjacent to said rivet formation, said flex line score having a first linear portion and a first curved portion; and forming a first break line score extending between and contacting both the first linear portion and the mustache score, further wherein the first break line score is score perpendicular to the first linear portion.

10. A method according to claim 9, wherein said flex line score is defined along a flex line score axis, and wherein said flex line score axis intersects said rivet formation.

11. A method according to claim 9, wherein said end panel has a diametric axis of symmetry, and wherein said first linear portion of said flex line score is substantially perpendicular to said diametric axis of symmetry.

12. A method according to claim 9, wherein said first linear portion is located on a first side of said rivet formation and a second linear portion is located on a second, opposite side of said rivet formation.

13. A method according to claim 9, wherein said first linear portion of said flex line score is located proximate to said rivet formation.

14. A method according to claim 13, wherein said first curved portion of said flex line score is located distal to said rivet formation.

15. A method according to claim 9, wherein said first curved portion of said flex line score is curved toward said mustache score.

16. The method of claim 1, further comprising second break line score, wherein said second break line score is parallel to said first break line score.

17. The method of claim 1, wherein said mustache score further comprises a first end portion which is closest to said flex line score, wherein and said first break line score is aligned with said first end portion.

18. The method of claim 9, further comprising second break line score, wherein said second break line score is parallel to said first break line score.

19. The method of claim 9, wherein said mustache score further comprises a first end portion which is closest to said flex line score, wherein and said first break line score is aligned with said first end portion.

* * * * *